US007905744B1

(12) United States Patent
Amidon

(10) Patent No.: US 7,905,744 B1
(45) Date of Patent: Mar. 15, 2011

(54) CARTRIDGE LOCK REGISTERED JACK AND METHOD OF USE THEREOF

(75) Inventor: Jeremy Amidon, Marcellus, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/582,245

(22) Filed: Oct. 20, 2009

(51) Int. Cl.
*H01R 11/20* (2006.01)
*H01R 4/24* (2006.01)
*H01R 4/26* (2006.01)

(52) U.S. Cl. ..... 439/417; 439/676; 439/941; 439/404

(58) Field of Classification Search ..... 439/676, 439/941, 418, 417, 404
See application file for complete search history.

(56) References Cited

U.S. PATENT DOCUMENTS

| | | | | |
|---|---|---|---|---|
| 5,571,035 | A | 11/1996 | Ferrill | |
| 6,007,384 | A | 12/1999 | Kraemer et al. | |
| 6,080,007 | A | 6/2000 | Dupuis et al. | |
| 6,283,768 | B1 | 9/2001 | Van Naarden | |
| 6,328,592 | B1 * | 12/2001 | Burke et al. | 439/417 |
| 6,332,802 | B2 | 12/2001 | Hirokawa | |
| 6,406,325 | B1 | 6/2002 | Chen | |
| 6,439,920 | B1 | 8/2002 | Chen | |
| 6,520,794 | B2 | 2/2003 | Liao | |
| 6,582,248 | B2 | 6/2003 | Bachman | |
| 6,783,402 | B2 | 8/2004 | Chen | |
| 6,805,588 | B2 | 10/2004 | Yamamoto | |
| 6,811,445 | B2 | 11/2004 | Caveney et al. | |
| 2005/0106929 | A1 | 5/2005 | Meckley et al. | |
| 2005/0153603 | A1 | 7/2005 | AbuGhazaleh et al. | |
| 2005/0266720 | A1 | 12/2005 | Lin | |
| 2006/0084324 | A1 | 4/2006 | Liao | |
| 2008/0020652 | A1 * | 1/2008 | Caveney et al. | 439/676 |
| 2008/0132123 | A1 * | 6/2008 | Milette et al. | 439/676 |

* cited by examiner

*Primary Examiner* — Javaid Nasri
(74) *Attorney, Agent, or Firm* — Schmeiser, Olsen & Watts, LLP

(57) ABSTRACT

The present invention relates to a cartridge lock registered jack and method of use thereof. The cartridge allows wires to be fed through and pulled tight around a retaining bar. This ensures that the wires terminate with the insulation displacement contact very close to the point at which the wires are still twisted. Termination is made by moving the cartridge to a locked position, which then pushes the wires into the insulation displacement contacts that displace the wire insulation to make contact.

21 Claims, 12 Drawing Sheets

CARTRIDGE LOCK REGISTERED JACK AND METHOD OF USE THEREOF

BACKGROUND OF INVENTION

1. Technical Field

The present invention relates generally to electrical connectors. In particular the invention relates to a cartridge lock registered jack connector and method of use thereof.

2. Related Art

Registered jacks are widely used in telecommunication systems for facilitating connection of electrical communication components. Ease of installation and consistent termination of internal insulated wires of a communications cable are two important features of a registered jack. Ordinary jacks are designed to orient untwisted wires of a cable for termination with corresponding wire contact terminals according to common communication standards. Standard jack designs involve termination of the untwisted wires with contacts at a terminal location spaced away from where the wires are still bundled and twisted. Wire termination in ordinary jacks is often tedious because each wire must be individually aligned and positioned for termination. Moreover wire termination in common jacks can be faulty because the wires are not precisely located for termination with the jack during cable installation and because wires are often loosely oriented during installation instead of being firmly positioned into a proper termination location. In addition, movement of a cable, once installed, can cause strain that may dislodge the wires from proper termination with ordinary jack terminal contacts. Some known jacks also require use of special tools in order to consistently terminate the wires during installation of the cable to the jack. Accordingly a need exists for an improved registered jack and related method of use.

SUMMARY OF THE INVENTION

A first aspect of the present invention provides a cartridge lock registered jack comprising: a housing, having a plug socket opening and a cartridge cavity; at least one conductive terminal, located within the housing, the conductive terminal having a first contact portion and a second contact portion, wherein the second contact portion extends into the socket; and a cartridge member, having two opposing box-wing portions flexibly attached to a gate portion including at least one vertical opening through which the first contact portion is extendable, wherein the cartridge member includes a retaining bar spaced apart from the at least one vertical opening and around which an insulated wire is positionable, wherein the cartridge member moves with respect to the housing between a first unlocked position and a second locked position, wherein when the cartridge member is in the second locked position the retaining bar acts upon an insulated wire positioned partially around the retaining bar and terminates the wire into electrical connection with the first contact portion of a corresponding at least one conductive terminal.

A second aspect of the present invention provides a registered jack comprising: a housing portion; a plug socket, extending into the housing portion; a cartridge cavity, extending into the housing portion; a plurality of insulation displacement contacts located within the housing portion; and a cartridge sized for insertion into the cartridge cavity in a direction substantially parallel to the direction of extension of the socket into the housing portion, the cartridge including a plurality of openings corresponding in size to the plurality of insulation displacement contacts, so that the plurality of insulation displacement contacts are each extendable through the plurality of openings when the cartridge resides in a locked position; and wherein the cartridge includes a retaining bar having a plurality of grooves for receiving a plurality of insulated wires wrapped around the retaining bar prior to and during insertion of the cartridge into the cartridge cavity, so that the plurality of insulated wires are electrically contacted by the plurality of insulation displacement contacts extending through the plurality of openings.

A third aspect of the present invention provides a method for assembling a cartridge lock registered jack, the method comprising: providing a housing, having a plug socket and a cartridge cavity; providing at least one conductive terminal within the housing, the conductive terminal having a first contact portion and a second contact portion; providing a cartridge member having a retaining bar spaced apart from a gate portion having a plurality of openings, the cartridge member being movable with respect to the housing; feeding at least one insulated wire through the space between the openings of the gate portion and the retaining bar; pulling tight at least one insulated wire and bending it about the retaining bar; and moving the cartridge member into the cartridge cavity until the tightened at least one insulated wire bent around the retaining bar is terminated and held in electrical contact with the first contact portion of a corresponding at least one conductive terminal.

A fourth aspect of the present invention provides an cartridge lock registered jack comprising: a housing, having a plug socket; at least one conductive terminal within the housing, the conductive terminal having a first contact portion and a second contact portion; a cavity extending into the housing, the cavity including pockets and guide tracks; and movable means for terminating and securing the received at least one insulated wire in electrical connection with the first contact portion, wherein the means include at least a retaining bar over which the at least one insulated wire may be bent.

DETAILED DESCRIPTION OF THE INVENTION

Figure 1:
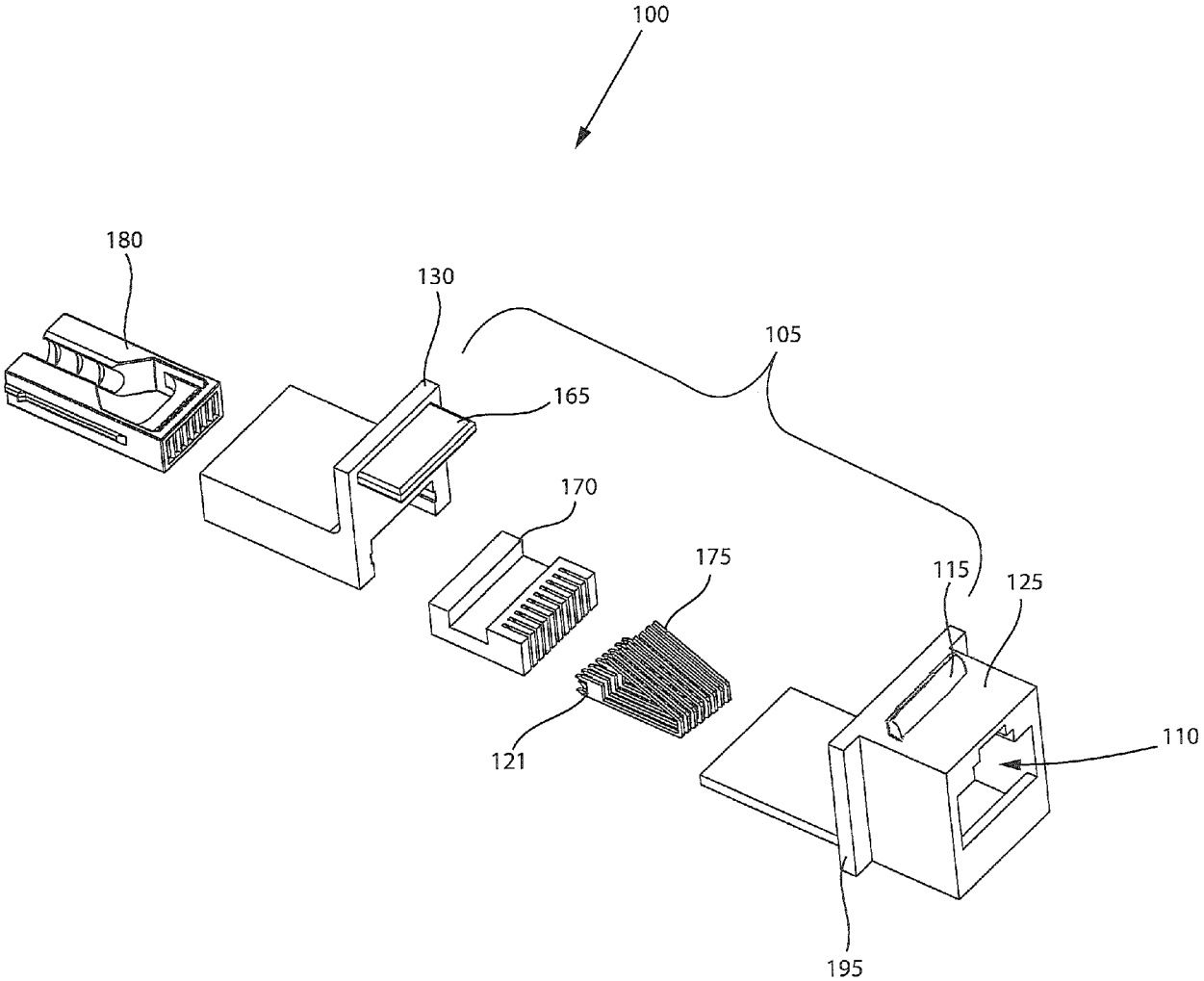
FIG. 1 shows an exploded perspective view of an embodiment of a cartridge lock registered jack connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a," "an" and "the" include plural referents, unless the context clearly dictates otherwise.

With reference to the drawings, FIG. 1 depicts an exploded perspective view of an embodiment of a cartridge lock registered jack connector 100. The cartridge lock registered jack connector 100 is shown, having a housing portion 105. Housing portion 105 may comprise two separate pieces, for example a first housing portion 125 and a second housing portion 130, attachably connected to form main body 105. Embodiments of a cartridge lock registered jack connector 100 may be configured according to typical registered jack communication standards. As such, the first housing portion 125 may include a plug socket 110 sized to accept a standard registered jack plug (shown in FIG. 12). The second housing portion 130 may include a mating element 165, such as protruding member or other physically engaging feature, in order to aid in the assembly of the overall housing portion 105. Mating element 165 may be designed to be inserted into a corresponding hollow of the first housing portion 125. The various component elements of the housing portion 105 may be formed of plastic material, or any other material that would help insulate electrical wiring from the outside environment, such as rubber or any other polymer. Moreover, various features of the overall housing portion 105 may be formed of different materials. For example the first body portion 125 may be formed of a clear plastic material, while the second body portion 130 may be formed of a different translucent plastic material. As further shown in FIG. 1, embodiments of a cartridge lock registered jack connector 100 include a cartridge 180, at least one conductive terminal 170 having an insulation displacement contact (IDC) member 121, and a conductive terminal housing 170.

Figure 2:
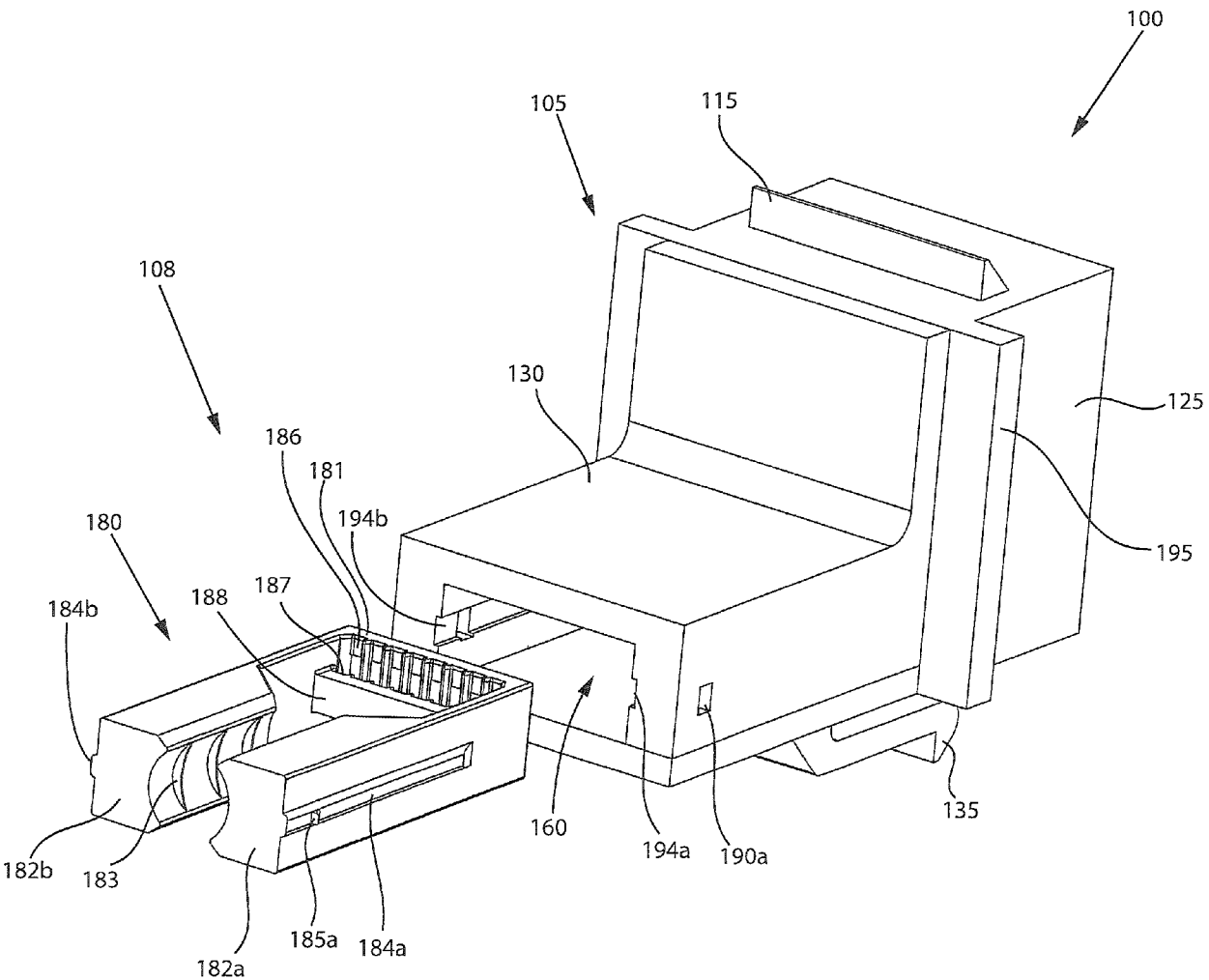
FIG. 2 shows a side perspective view of an embodiment of a cartridge lock registered jack connector with the cartridge in an unlocked position, in accordance with the present invention.

Referring still to FIG. 1 and with additional reference to FIG. 2, housing portion 105 may further comprise a resilient latch tab 135. The resilient latch tab 135 may cooperate with fixed latch member 115 to releasably retain the cartridge lock registered jack connector 100 in assembly with an associated apertured wall plate (not shown). The resilient latch tab 135 and the fixed latch member 115 may be located on opposing faces of the overall housing body portion 105. It should be understood by one of ordinary skill that latching combination 135, 115 is not limited to that as shown in FIGS. 1-12, but may also be a fastener, a catch, a clasp, a clench, a grip, a hold, a lock, a press, a snap and a vice, as screw, a bolt, or any other fastening structure, so long as cartridge lock registered jack connector 100 is releasably retained in operable assembly with an associated wall plate or other mounting device. A flange member(s) 195 extending from the housing portion 105 may also serve to assist in operably attaching the cartridge lock registered jack connector 100 to a mounting device.

As mentioned, embodiments of a cartridge lock registered jack connector 100 include a plug socket 110 opening up into the housing 105. The socket 110 may be located on a face of main body 105, and may be configured to accept a cable plug, including, but not limited to any type of registered jack (RJ) connector. For example, socket 110 may be configured to accept the plug connector of a shielded twisted pair (STP) cable, an unshielded twisted pair (UTP) cable, a screened shielded twisted pair (S/STP) cable, a fully shielded twisted pair (FTP) cable, or any variant thereof. Embodiments of a cartridge lock registered jack connector 100 may therefore be any form of registered jack.

Turning further to FIG. 2, greater detail is depicted with respect to various connector 100 components including the cartridge 180 member. As shown, the cartridge 180 may be a plug-like body configured to receive and capture a cable 10, when the cartridge 180 is inserted into a corresponding cartridge cavity 160 of the housing portion 105. The cartridge cavity extends into the housing 105 opposite the plug socket 110. The cartridge member may include two opposing box-wing members 182*a* and 182*b*, wherein the box-wing members 182*a-b* may be flexibly attached to a gate portion 181. The gate portion may include a plurality of vertical slits or openings 186, the number of which may correspond to the number of conductive terminals operably associated with the cartridge lock registered jack connector 100 embodiment. Spaced apart from the gate portion 181 is a retaining bar 188, wherein the retaining bar 188 spans a distance between the box-wing members 182*a* and 182*b*. The retaining bar 188 may included a plurality of grooves 187 or depressions, wherein the grooves may be sized to receive a wire from a twisted wire pair of a communication cable 10 ultimately connected to the cartridge lock registered jack connector 100. On an inner portion of one or both of the box-wing members 182*a-b* may be at least one gripping rib 183. The gripping rib(s) 183 may serve to compress against a received cable 10 to help prevent movement of the cable 10 once the cartridge 180 has been inserted to a locked position 118 (see FIGS. 4-5) within the housing portion 105. When in an unlocked position 108, the cartridge 180 may be completely structurally free from the housing portion 105. However, other embodiments may be employed wherein the cartridge 180 remains slightly attached to the body during cable 10 installation. To help guide the cartridge 180 during insertion into the body, guide rails 184*a* and 184*b* may be located on the outer faces of opposing box-wing members 182*a* and 182*b*. The guide rails 184*a-b*, may correspond in size and shape to guide tracks 194*a* and 194*b* formed on opposing surfaces of the cavity 160. As such, the guide rails 184*a-b* may be slightly smaller than the guide tracks 194*a-b* of the cavity 160 of the housing portion 105. Yet it should be appreciated that the tolerance between the parts may facilitate ready insertion, but prevent active wiggling once inserted. The front edges of the guide rails 184*a-b* may be ramped or tapered so as to facilitate ready insertion into the guide tracks 194*a-b* of the cavity 160 of housing portion 105 of an embodiment of a cartridge lock registered jack connector 100.

Figure 3:
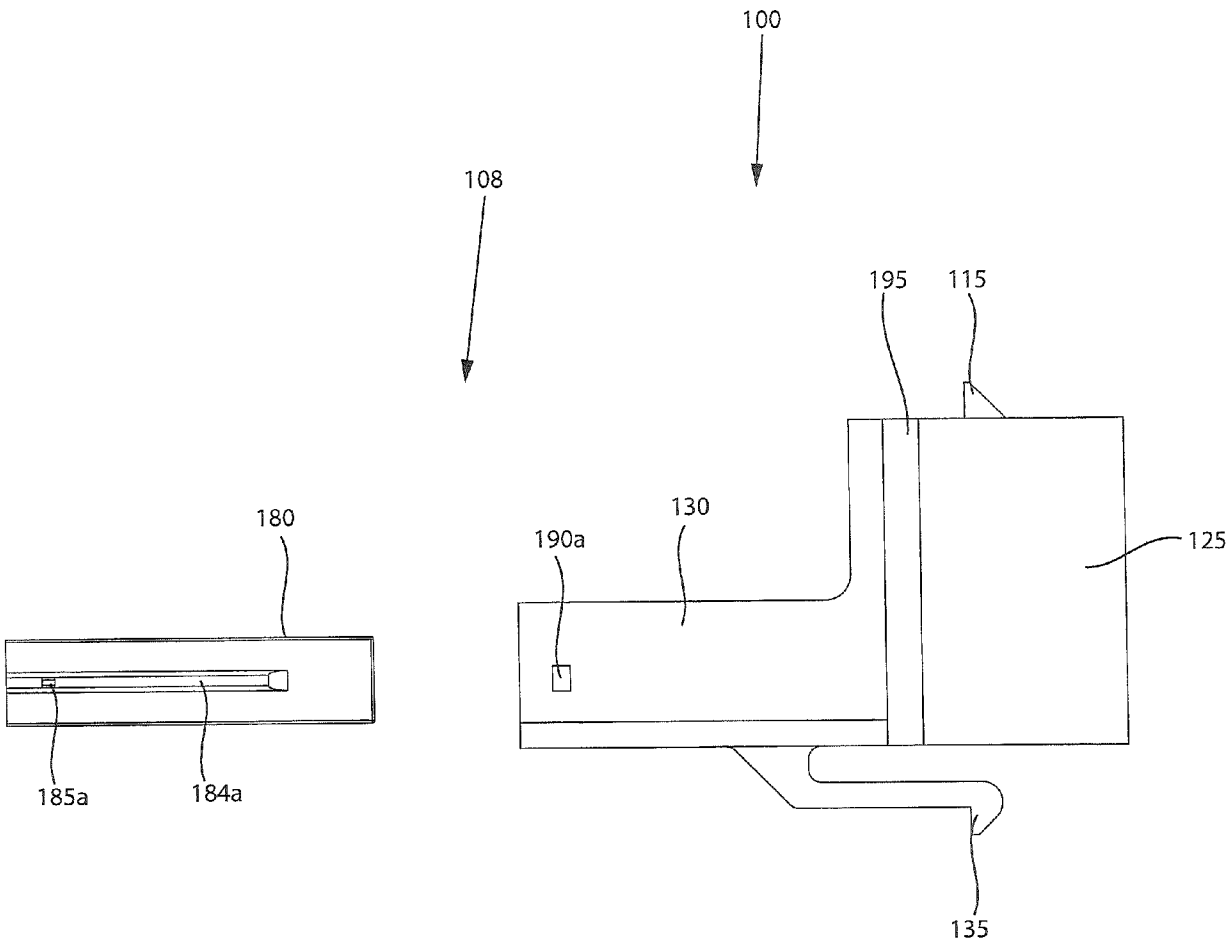
FIG. 3 shows side view of an embodiment of a cartridge lock registered jack connector with the cartridge in an unlocked position, in accordance with the present invention.
Figure 4:
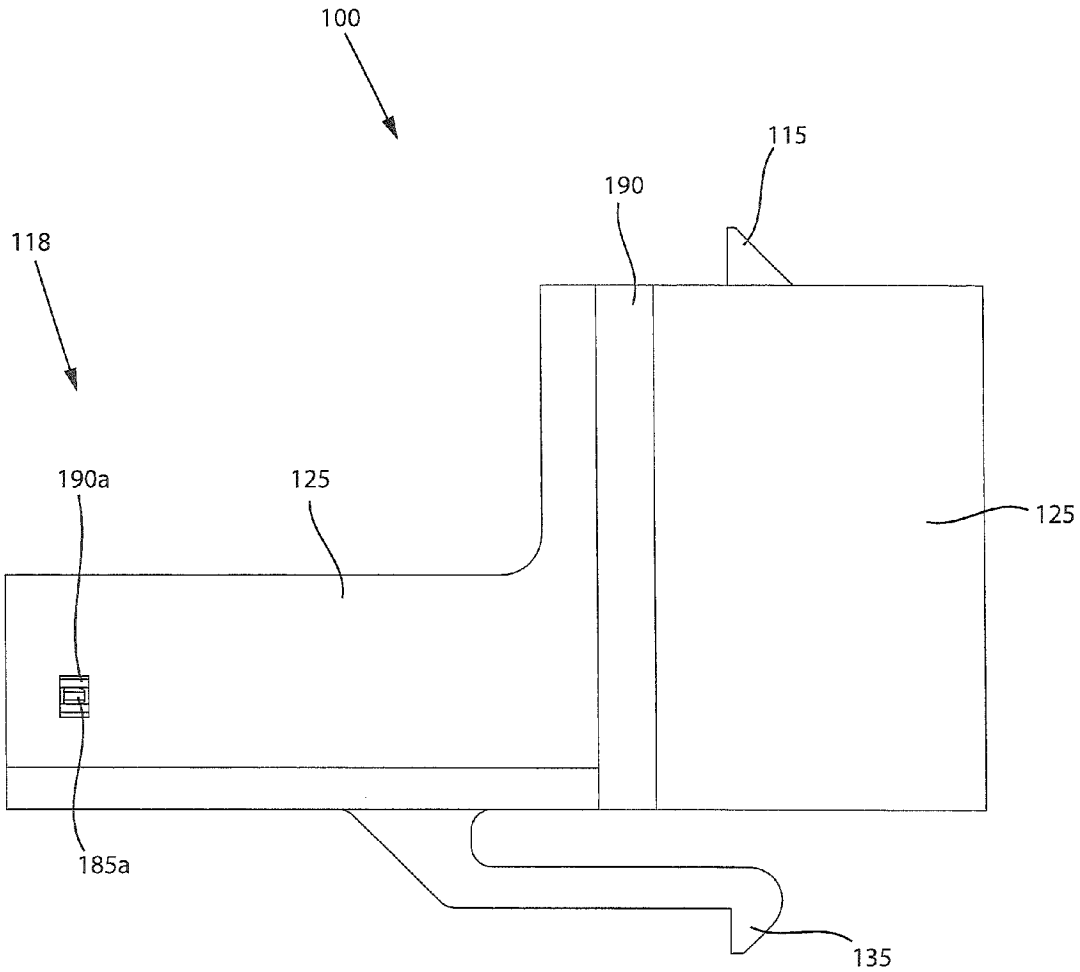
FIG. 4 shows a side view of an embodiment of a cartridge lock registered jack connector with the cartridge in a locked position, in accordance with the present invention.

With further reference to FIGS. 1-2 and additional reference to FIGS. 3-4, the unlocked 108 and locked 118 positions of the cartridge 180 are explained in greater detail. When in an unlocked position 108, the cartridge 180 may be freely moveable and locatable with respect to the housing portion 105. However, as described above, an unlocked position 108 may also correspond to a position of the cartridge 180 with the housing portion 105, such that the cartridge member 180 may be connected to the housing portion 105, but still be movable with respect to the housing portion 105. When in a locked position 118, the cartridge 180 becomes secured to and substantially immovable with respect to the housing portion 105. The physical securing of the 180 within the housing portion 105 may be facilitated by locking tabs 185*a* and 185*b* that protrude from the guide rails 184*a* and 184*b* near the rear of the box-wing members 182*a* and 182*b*. The shape of the protruding tabs 185*a-b* may be ramped or tapered so as to allow the tabs 185*a-b* to click into side pockets 190*a* and 190*b* in the cavity 160. The side pockets 190*a* and 190*b* may be holes extending through the guide tracks 194*a-b* and out the sides of housing portion 105. Hence, when the cartridge member 180 is inserted into the cavity, such that the locking tabs 185*a-b* click into the side pockets 190*a-b*, then the physical interference fit between the protruding locking tabs 185*a-b* and the pockets 190*a-b* into which the tabs 185*a-b* extended thereby renders the parts substantially immovable with respect to each other. This immovability of the parts correlates with a locked position 118. If for some reason, it was necessary to remove the cartridge 180 from the locked position 118 within the housing portion 105 then the tabs 185*a-b* may be pushed out of interference with the pockets 190*a-b* by inserting a tool or other implement through the pocket openings on the outside of the housing portion 105 until the tabs are moved out of physical interference, thereby allowing retraction of the cartridge 180 from out of the housing portion 105.

Figure 5:
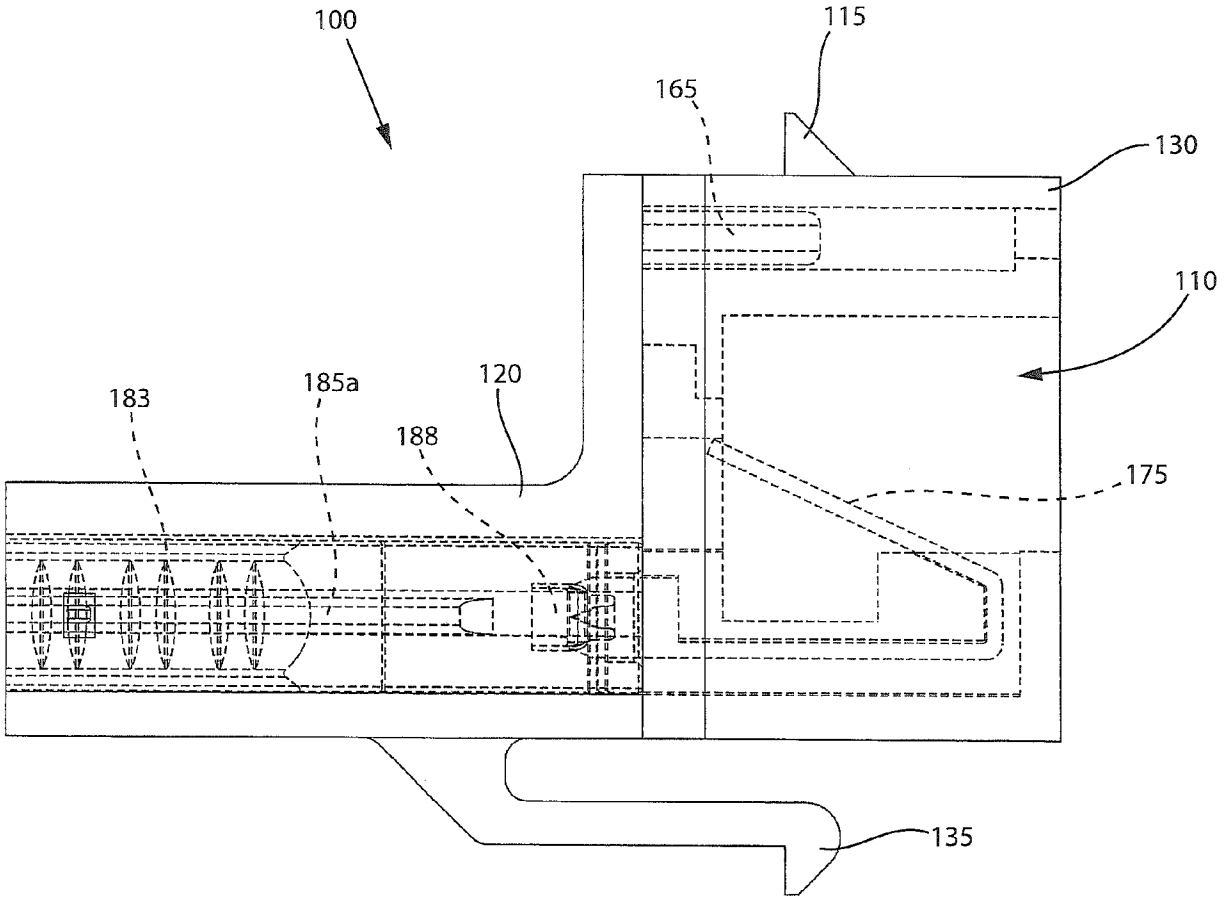
FIG. 5 shows a side view of an embodiment of a cartridge lock registered jack connector with the cartridge in a locked position, with internal components shown in ghosted lines, in accordance with the present invention.
Figure 6:
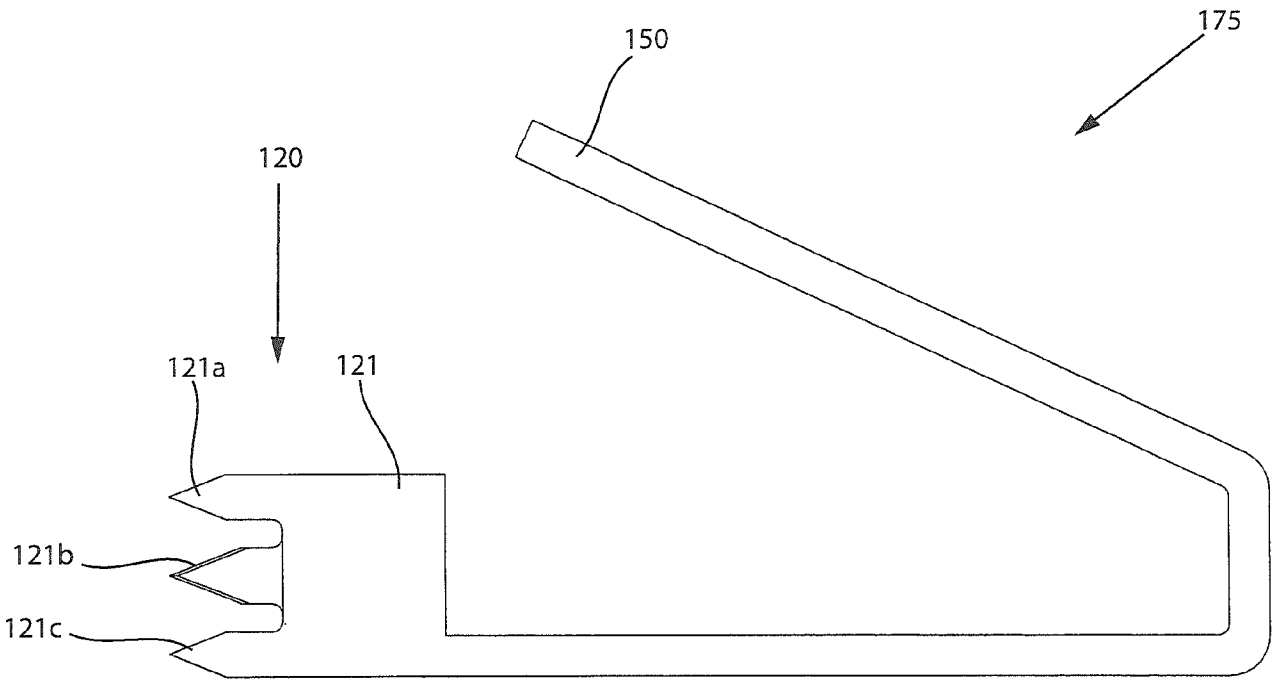
FIG. 6 shows a side view of an embodiment of a conductive terminal, in accordance with the present invention.

Referring further to the drawings, FIGS. 5-6 depict a side view of an embodiment of a cartridge lock registered jack connector 100 with the cartridge 180 in a locked position, with internal components shown in ghosted lines, wherein one of those internal components, the conductive terminal 175, is embodied as depicted in FIG. 6. As can be seen in FIG. 5, when the cartridge 180 is in a locked position 118, the insulation displacement contact 121 members of the conductive terminals 175 extend through the vertical openings 186 of the gate portion 181 of the cartridge 180. In this manner, when the wires from the twisted wire pairs are disposed in the space between the vertical openings 186 and the retainer bar 188, then the insulation displacement contacts (IDCs) 121 can pierce the wires and make electrical contact therewith. The mating element 165 of the second housing portion 130 can be seen (in ghosted lines) located in a mated position with a corresponding opening of the first housing portion 125. Moreover, it can also be seen that the second contact portions 150 of the conductive terminals 175 extend a distance into the plug socket opening 110 when the cartridge lock registered jack connector 100 is assembled.

As depicted in FIG. 6, embodiments of a cartridge lock registered jack connector 100 include at least one conductive terminal 175. The conductive terminal 175 may be housed within the housing portion 105 of the cartridge lock registered jack connector 100. A further conductive terminal housing 170 may also be provided to further house, orient, and protect the conductive terminals 175. A conductive terminal 175 may include a first wire contact portion 120 having one or more wire contact points, such as insulation displacement contacts (IDCs) 121*a-c*, and a second wire contact portion 150. The may have sharpness sufficient to pierce or slice the insulation of the wires 60-67, thereby terminating insulated wires 60-67. There may be a plurality of IDCs 120 each corresponding to at least one insulated wire 60-67. In operation, the first contact portion 120 and the second contact portion 150 may be located within conductive terminal housing 170. However, the first contact portion 120 and the second contact portion 150 may also be operably located outside of conductive terminal housing 170. Second contact portion 150 may be a conductive finger, configured to be electrically connected to a modular plug (shown in FIG. 12), whereby the conductive finger 150 may be located within socket 110, as described above.

Figure 7:
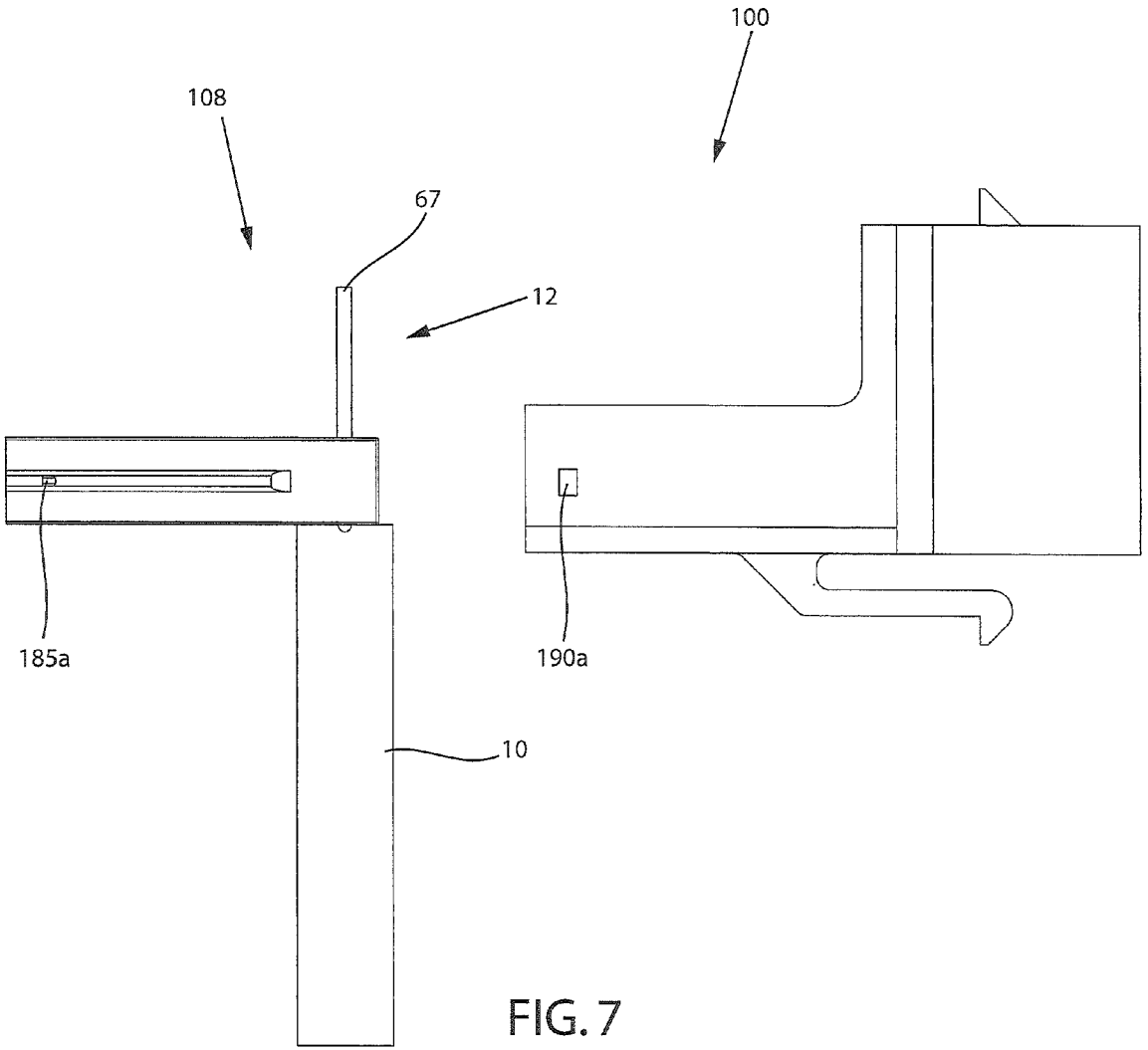
FIG. 7 shows a side view of an embodiment of a cartridge lock registered jack, wherein a cable is initially engaging the cartridge in an unlocked position, in accordance with the present invention.
Figure 8:
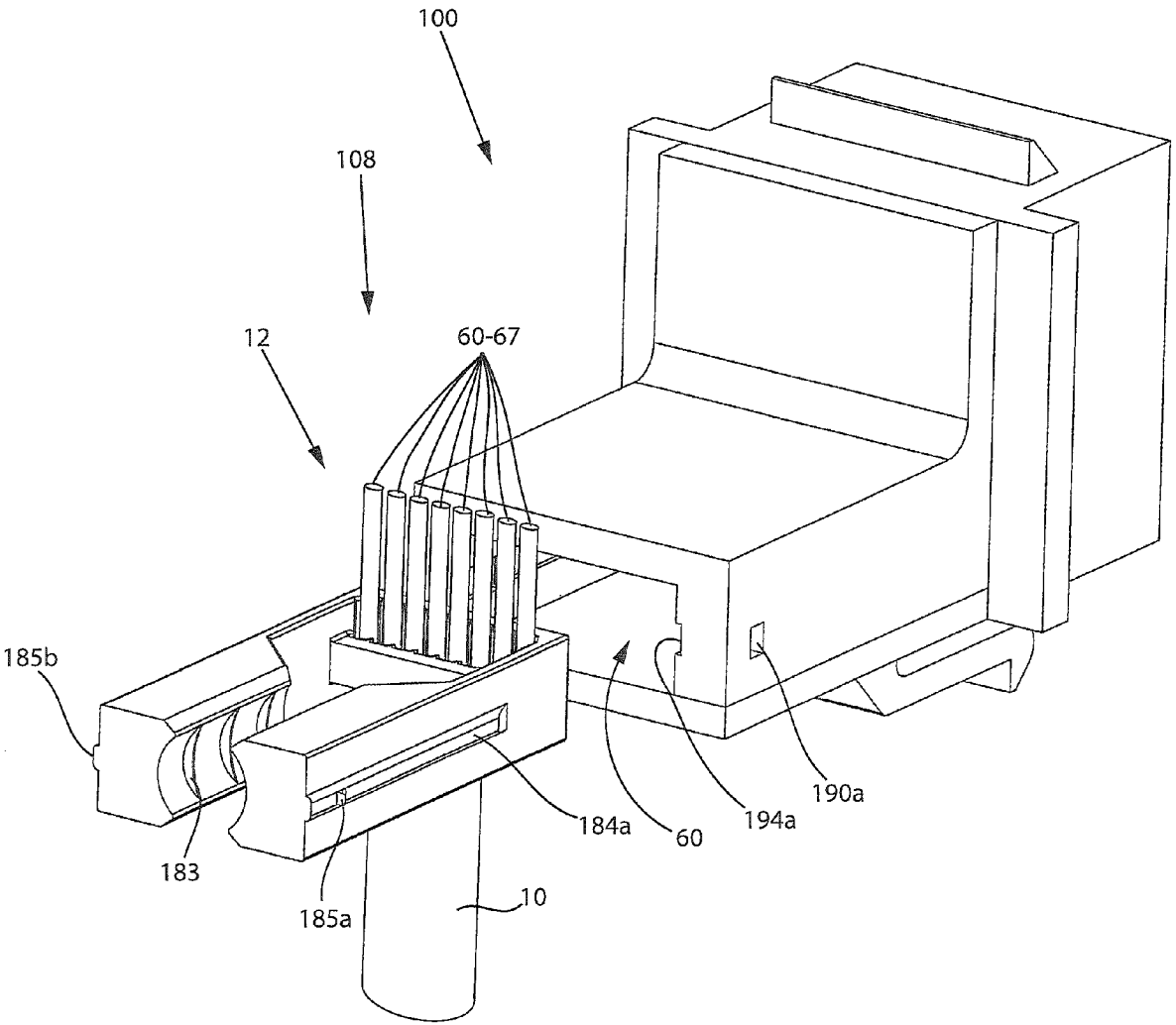
FIG. 8 shows a side perspective view of an embodiment of a cartridge lock registered jack, wherein a cable is initially engaging the cartridge in an unlocked position, in accordance with the present invention.
Figure 9:
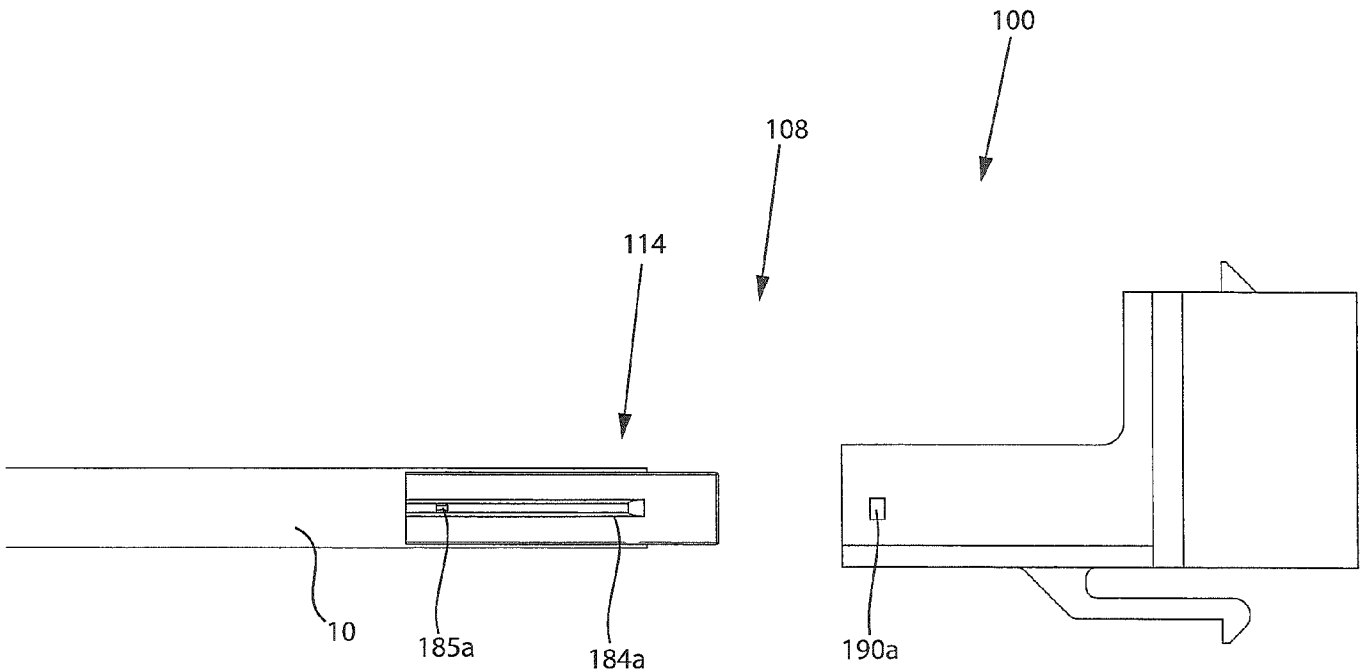
FIG. 9 shows a side view of an embodiment of a cartridge lock registered jack, wherein a cable is fully engaging the cartridge in an unlocked position, in accordance with the present invention.
Figure 10:
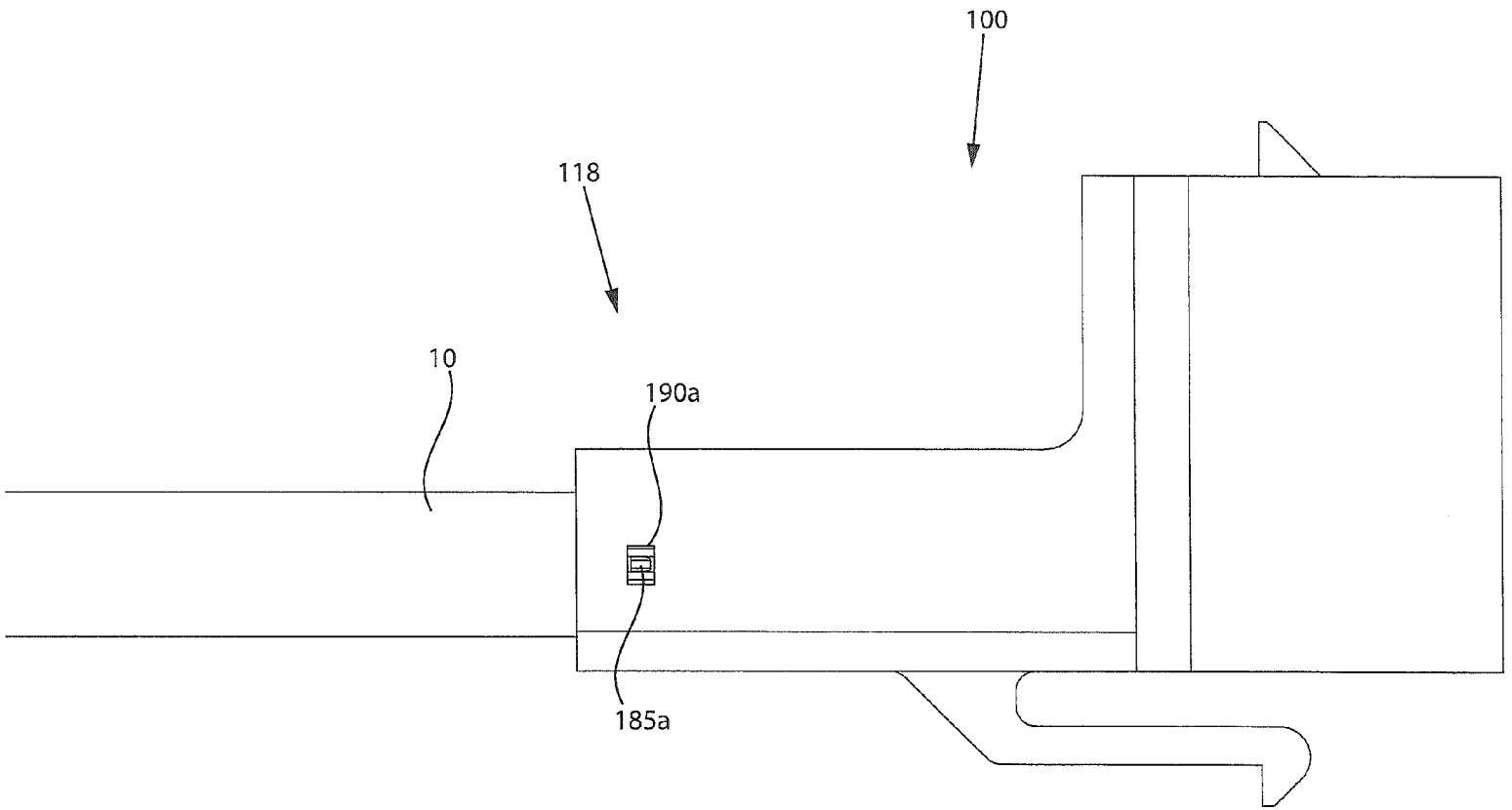
FIG. 10 shows a side view of an embodiment of a cartridge lock registered jack, wherein a cable is fully engaging the cartridge in a locked position, in accordance with the present invention.

With continued reference to FIGS. 1-6 and additional reference to FIGS. 7-10, further description is herein provided with respect to the installation of a cable 10 with embodiments of a cartridge lock registered jack connector 100. The cable 10 typically includes a plurality of twisted wire pairs. For example, the cable 10 may include 8 individual wires, such as wires 60, 61, 62, 63, 64, 65, 66, and 67 depicted in FIG. 8. It is advantageous to terminate the connection and make electrical contact with the wires 60-67 as close to the twisted wire pair configuration as possible, because of the extra physical strength and electromagnetic performance associated with the wire pairs. When installing a cable 10, a user may trim the cable 10 and untwist the wire pairs a distance sufficient to separate the wires 60-67. The untwisted wires 60-67 may then be inserted through the space between the gate portion 181 and the retaining bar 188 of the cartridge 180. The wires 60-67 may also be positioned and nestled into corresponding grooves 187 formed on the retaining bar 188 on the side facing the gate portion 181 of the cartridge 180. When the insulated wires 60-67 extend through the opening between the retaining bar 188 and the gate portion 181, the wires 60-67 may be pulled tight until the twisted pairs and the main body of the cable 10 abut the bottom surface of the cartridge 180. This pulling tight may help ensure that the ultimate termination of the wires occurs at a location close to the wire pair configuration. Excess wire 60-67 may be cut if the wires 60-67 extend too far. As depicted in FIGS. 7-8, the cable 10 is in an initially engaging position 12 with respect to the cartridge 180. Insulated wires 60-67 may be the internal twisted wires of a STP, UTP, S/STP, or FTP cable 10, as described above.

Once the wires 60-67 are pulled tight, they can be bent down around the retaining bar 188, while the remaining body of the cable 10 can be bent up to reside between the box-wing members 182*a-b* of the cartridge 180. In this manner, the untwisted wires 60-67 may remain in a fairly taut and vertically straight alignment about the retaining bar 188. The box-wing members 182*a-b* may have some flexibility to accommodate the body of the cable within. Once the cable 10 is received, the box-wing members 182*a-b* may be compressed upon the cable 10 body to begin to more fully secure the cable 10 into position with respect to the cartridge 180. Hence, with the body of the cable 10 properly bent up into position and with the wires 60-67 properly bent down and around the retaining bar 188, the cartridge 180 and cable 10 are in a fully engaging position 14 and are prepared for insertion and securing within the housing portion 105. Insertion involves the cartridge 180, with the fully engaged cable 10 being pushed, driven or otherwise located within the cavity 160, until it is secure. The cartridge 180 is movable between a first unlocked position 108 and a second locked position 118 in a direction substantially parallel to the direction of extension of the socket 110 into the housing 105. As described above, insertion may involve operable movable interaction between the guide rails 184*a-b* and the guide tracks 194. Securing the cable 10 in a locked position 118 with respect to the housing portion 105 involves the employment of an interference fit between the locking tabs 185*a-b* of the cartridge 180 and the side pockets 190*a-b* of cavity 160. While being inserted into the cavity 160, the cartridge 180 may be compressed together, such that the cable is somewhat crimped by the gripping ribs 183 on the inner portions of the box-wing members 182*a* and 182*b*. When compressed within the cartridge 180, in this manner, the cable 10 is securely fastened to the registered jack connector 100 and has a heightened capacity to resist strain that, with regard to ordinary jack terminal contacts may dislodge the wires from proper termination. Insulated wires 60-67 may be held in electrical connection with conductive terminal 175 by the insertion of cartridge 180 into cavity 160, so that the cartridge 180 is secured into a compressed locked position 118, wherein the wires 60-67 are engaged by the contact points 121 of IDC's 120.

Figure 11:
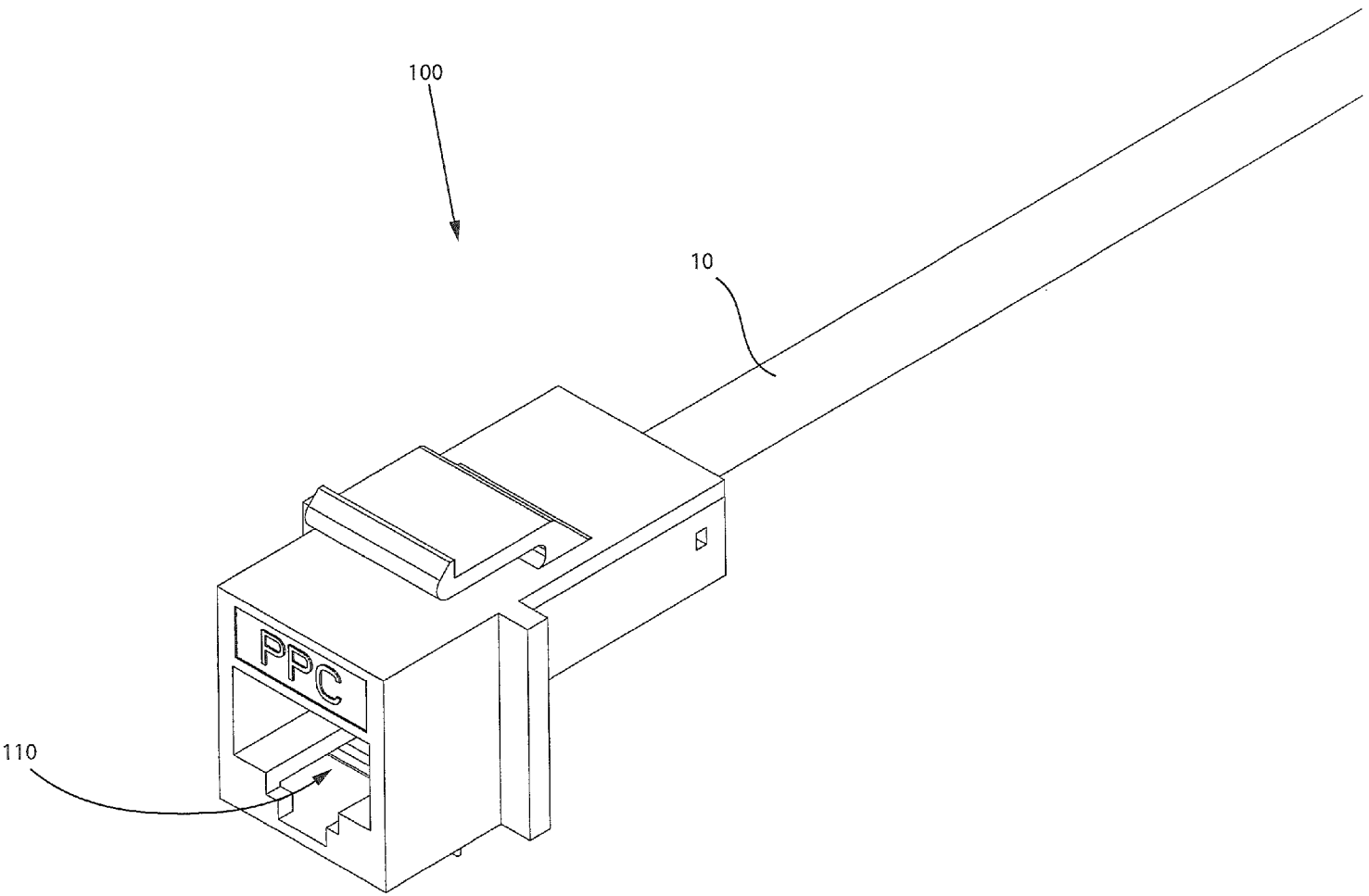
FIG. 11 shows a perspective view of an embodiment of a cartridge lock registered jack, wherein a cable is fully engaging the cartridge in a locked position, in accordance with the present invention.
Figure 12:
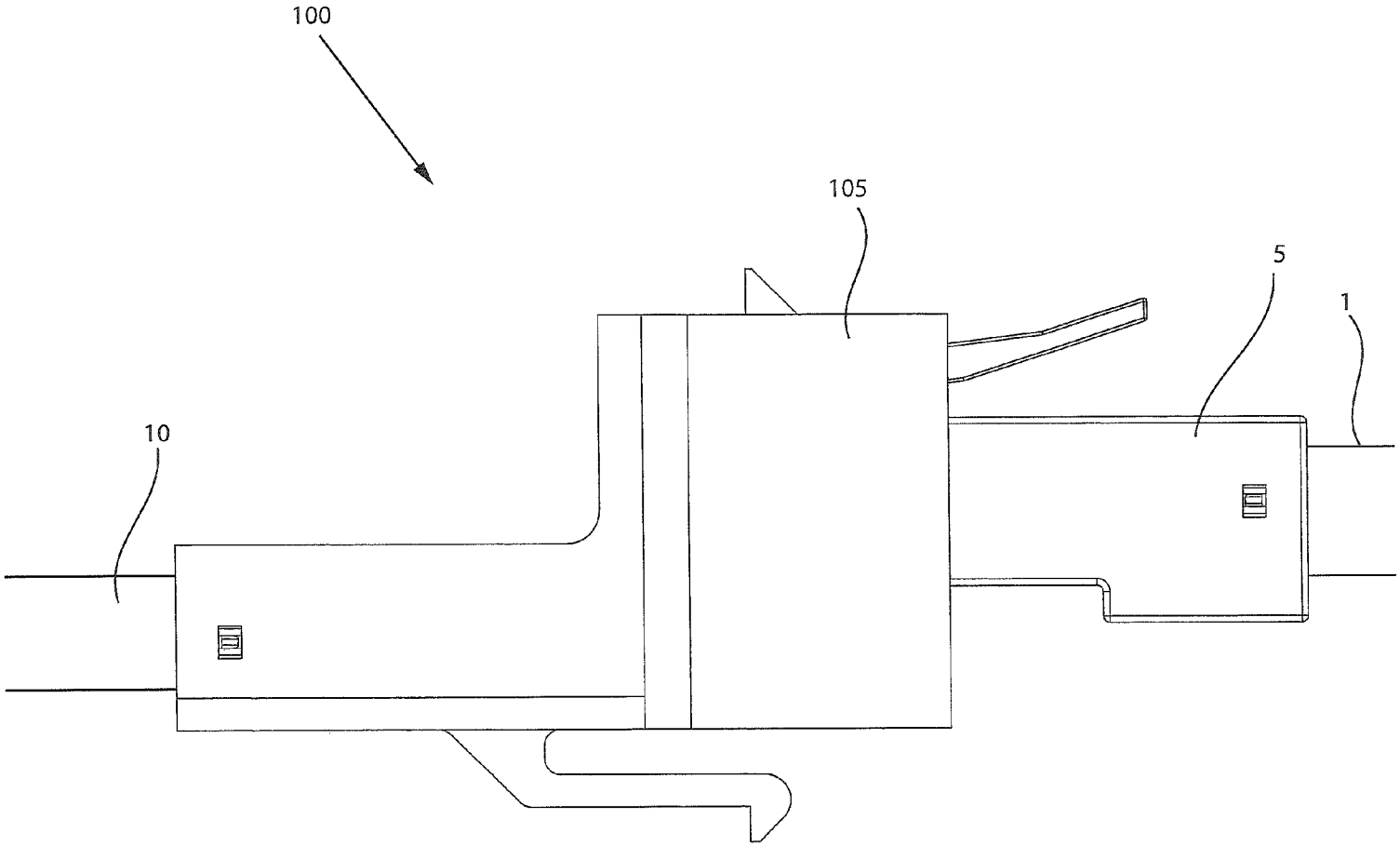
FIG. 12 shows a side view of an embodiment of a cartridge lock registered jack, wherein a cable is fully engaging the cartridge in a locked position, and wherein the jack has received a corresponding connector plug, in accordance with the present invention.

Once an embodiment of a cartridge lock registered jack 100 has been installed with a cable, wherein the cable 10 is fully engaging the cartridge 180 in a locked position 118, the jack 100 is in condition for use. For example, as depicted in FIG. 11, an embodiment of a cartridge lock registered jack 100 includes a plug socket 110 for connecting the terminals of the plug with the wires, such as wires 60-67, so that electromagnetic communications may extend therethrough. Moreover, as depicted in FIG. 12, a registered jack plug 5, having an installed cable 1, may be operably connected to the cartridge lock registered jack 100. Optimally, the jack 100 may help facilitate a signal exchange from cable 1 to cable 10, wherein there is little to no signal loss through the cartridge lock registered jack 100.

It will be apparent to those skilled in the art that the means for terminating and securing the received insulated wire 60-67 in electrical connection with the first contact portion may take various forms. For example, terminating means may include a separable cartridge 180, operable with a housing body 105 to lock the wires 60-67 into electrical connection, as described hereinabove, or alternately, embodiments of the cartridge lock registered jack connector 100 may not include a separable cartridge 180. Instead, terminating means may comprise the entire housing 105 sliding forward, with respect to an integral cartridge-like component, thereby compressing insulated wire 60-67 against insulation displacement contact 120 when the wires have been pulled tight around the retaining bar 188.

Referring to FIGS. 1-12, a method for assembling a cartridge lock registered jack connector 100 comprises providing a housing containing a socket which is configured to receive a plug. The housing and socket may be similar to those described hereinabove as housing 105 and socket 110, as shown in FIGS. 1-12. The plug 5 may be any standard plug operable with internal twisted wires of a STP, UTP, S/STP, or FTP cable, such as cable 10. For instance, the plug may be a typical registered jack plug, such as an RJ-45 plug. Further methodology includes providing at least one conductive terminal within the housing, the conductive terminal having a first and second contact portion, the second contact portion configured for electrical connection to the plug 5. The conductive terminal and first and second contact portions may be similar to those described hereinabove as conductive terminal 175, first contact portion 120, and second contact portion 150, as shown in FIGS. 1-12. Additionally, the cartridge lock registered jack assembly method includes a step of providing a cartridge member 180 having a retaining bar 188 spaced apart from a gate portion 181 having a plurality of openings 186, the cartridge member 180 being movable with respect to the housing 105. Moreover the methodology includes feeding at least one insulated wire 60-67 through the space between the openings 186 of the gate portion 181 and the retaining bar 188 and also pulling tight at least one insulated wire 60-67 and bending it about the retaining bar. Still further the methodology includes moving the cartridge member 180 into the cartridge cavity 160 until the tightened at least one insulated wire 60-67 bent around the retaining bar 188 is terminated and held in electrical contact with the first contact portion 120 of a corresponding at least one conductive terminal 175.

In addition to the methodology described above, the cartridge lock registered jack assembly method may further comprise a step of untwisting twisted insulated wires 60-67 before feeding the wires into the space of the cartridge member 180 between the gate portion 181. This step may include orienting the twisted pairs into proper position so that they may be fed into corresponding grooves 187 of the retaining bar 188. The proper position of the wires may correspond to the type of cartridge lock registered jack connector being assembled. For instance, assembly of a registered jack may include untwisting the wires and positioning them in the conduit for contact with conductive terminals that corresponding to a specific registered jack configuration, such as an RJ-45 configuration.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

I claim:

1. A cartridge lock registered jack comprising:

a housing, having a plug socket opening and a cartridge cavity;

at least one conductive terminal, located within the housing, the conductive terminal having a first contact portion and a second contact portion, wherein the second contact portion extends into the socket; and a cartridge member, having two opposing box-wing portions flexibly attached to a gate portion including at least one vertical opening through which the first contact portion is extendable, wherein the cartridge member includes a retaining bar spaced apart from the at least one vertical opening and around which an insulated wire is positionable, wherein the cartridge member moves with respect to the housing between a first unlocked position and a second locked position, wherein when the cartridge member is in the second locked position the retaining bar acts upon an insulated wire positioned partially around the retaining bar and terminates the wire into electrical connection with the first contact portion of a corresponding at least one conductive terminal.

2. The cartridge lock registered jack connector jack of claim 1, wherein the cartridge further comprises a locking tab operable with a pocket of the cartridge cavity.

3. The cartridge lock registered jack connector jack of claim 1, wherein the cartridge member further comprises a guide rail operable with a guide track of the cartridge cavity.

4. The cartridge lock registered jack connector jack of claim 3, wherein the cartridge member is movable between the first unlocked position and the second locked position in a direction substantially parallel to the direction of extension of the socket into the housing.

5. The cartridge lock registered jack connector jack of claim 3, wherein the cartridge member further comprises at least one gripping rib positioned on an inner surface of a box-wing portion.

6. The cartridge lock registered jack connector jack of claim 1, wherein the first contact portion has a sharpness sufficient to pierce the insulation of the at least one insulated wire.

7. The cartridge lock registered jack connector jack of claim 1, wherein the housing is assembled from at least two pieces.

8. The cartridge lock registered jack connector jack of claim 1, wherein the at least one insulated wire is perpendicularly aligned with the first contact portion, wherein the insulation of the wire is pierced by the first contact portion when the retaining bar of the cartridge is moved to a locked position.

9. The cartridge lock registered jack connector jack of claim 1, wherein the jack is an RJ-45 jack.

10. A cartridge lock registered jack comprising:

a housing portion;

a plug socket, extending into the housing portion;

a cartridge cavity, extending into the housing portion;

a plurality of insulation displacement contacts located within the housing portion; and a cartridge sized for insertion into the cartridge cavity in a direction substantially parallel to the direction of extension of the socket into the housing portion, the cartridge including a plurality of openings corresponding in size to the plurality of insulation displacement contacts, so that the plurality of insulation displacement contacts are each extendable through the plurality of openings when the cartridge resides in a locked position; and wherein the cartridge includes a retaining bar having a plurality of grooves for receiving a plurality of insulated wires wrapped around the retaining bar prior to and during insertion of the cartridge into the cartridge cavity, so that the plurality of insulated wires are electrically contacted by the plurality of insulation displacement contacts extending through the plurality of openings.

11. The cartridge lock registered jack of claim 10, wherein the cartridge includes locking tabs positioned to employ an interference fit with corresponding structure of the cavity.

12. The cartridge lock registered jack of claim 11, wherein the cartridge cavity includes guide tracks.

13. The cartridge lock registered jack of claim 10, wherein cartridge includes guide rails.

14. The cartridge lock registered jack of claim 10, wherein the cartridge includes opposing box-wing portions.

15. The cartridge lock registered jack of claim 14, wherein the opposing box-wing portions each include inner gripping ribs.

16. A method for assembling a cartridge lock registered jack, the method comprising:

providing a housing, having a plug socket and a cartridge cavity;

providing at least one conductive terminal within the housing, the conductive terminal having a first contact portion and a second contact portion;

providing a cartridge member having a retaining bar spaced apart from a gate portion having a plurality of openings, the cartridge member being movable with respect to the housing;

feeding at least one insulated wire through a space between the openings of the gate portion and the retaining bar;

pulling tight at least one insulated wire and bending it about the retaining bar; and moving the cartridge member into the cartridge cavity until the tightened at least one insulated wire bent around the retaining bar is terminated and held in electrical contact with the first contact portion of a corresponding at least one conductive terminal.

17. The method of claim 16, wherein the housing is assembled from at least two pieces.

18. The method of claim 16, wherein the cartridge includes locking tabs and the cartridge cavity includes corresponding pockets into which the locking tabs extend when the cartridge obtains a locked position.

19. The method of claim 16, further comprising crimping the wire cable between two opposing box-wing portions of the cartridge.

20. The method of claim 16, wherein movement of the cartridge into the cartridge cavity is enhanced by operable interaction of guide rails of the cartridge with guide tracks of the cavity.

21. A cartridge lock registered jack comprising:

a housing, having a plug socket;

at least one conductive terminal within the housing, the conductive terminal having a first contact portion and a second contact portion;

a cavity extending into the housing, the cavity including pockets and guide tracks; and movable means for terminating and securing the received at least one insulated wire in electrical connection with the first contact portion, wherein the means include at least a retaining bar over which the at least one insulated wire may be bent, wherein the movable means moves the received at least one insulated wire with respect to the housing.

* * * * *